US006388508B1

(12) United States Patent
Kawasumi

(10) Patent No.: US 6,388,508 B1
(45) Date of Patent: May 14, 2002

(54) CURRENT MIRROR CIRCUIT AND CURRENT SOURCE CIRCUIT

(75) Inventor: Atsushi Kawasumi, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/449,382

(22) Filed: Nov. 24, 1999

(51) Int. Cl.[7] ..... G05F 1/10
(52) U.S. Cl. ..... 327/543; 323/316
(58) Field of Search ..... 327/513, 408, 327/543; 323/312, 316, 315

(56) References Cited

U.S. PATENT DOCUMENTS 5,982,227 A * 11/1999 Kim et al. ..... 327/543
6,181,191 B1 * 1/2001 Paschal ..... 327/513

* cited by examiner

*Primary Examiner*—Jung Ho Kim
(74) *Attorney, Agent, or Firm*—Banner & Witcoff, Ltd.

(57) ABSTRACT

A current mirror circuit that provides an excellent current that does not deteriorate, even when the power source is lower supply voltage. A mirror current flows in a first MOS transistor when a constant current flows in the MOS transistor from a current source. A subtracter outputs the difference between voltage $V_{g1}$ of the gate of the MOS transistor and Voltage $V_{d1}$ of the drain, and applies this difference to the gate of a second MOS transistor. When the power-supply voltage of this circuit becomes lower supply voltage and the absolute value of $V_{d1}$ decreases, the MOS transistors enter the triode region, and the mirror current decreases when the absolute value of $V_{d1}$ decreases, because the difference between $V_{g1}$ and $V_{d1}$ becomes larger, the drain current of the second MOS transistor increases, and the amount by which the mirror current decreases is counterbalanced.

9 Claims, 9 Drawing Sheets

CURRENT MIRROR CIRCUIT AND CURRENT SOURCE CIRCUIT

CROSS REFERENCE TO RELATED APPLICATIONS

This application claims benefit of priority under 35 USC 119 based on Japanese patent application P10-338008, filed Nov. 27, 1998, the entire contents of which are incorporated by reference herein.

BACKGROUND OF THE INVENTION

1. Field of the Invention

This invention relates to a current mirror circuit suitable for use with a lower voltage power supply.

2. Description of Related Art

Current mirror circuits have previously comprised MOS (Metal Oxide semiconductor) transistor and used with various semiconductor circuits. FIG. 1 illustrates static characteristics of an NMOS transistor. The horizontal axis indicates the drain source voltage $V_{ds}$ applied to an NMOS transistor and the vertical axis indicates the drain current $I_d$. The relation between $I_d$ and $V_{ds}$ is shown as the gate source voltage $V_{gs}$ changes. The dotted line in FIG. 1 represents a boundary of two regions that exist between $I_d$ and $V_{ds}$. One region is on the left side of the dotted line is called the triode region, where $I_d$ is represented by equation I.

When $(V_{gs}-V_t)>V_{ds}$, $$I_d=\beta[(V_{gs}-V_t)V_{ds}-\tfrac{1}{2}V_{ds}^2] \quad \text{(I)}$$

Where, $V_t$ is threshold voltage of the MOS transistor.

The other region is on the right side of the dotted line and is called the pentode region, where $I_d$ is represented by equation II.

When $(V_{gs}-V_t)<V_{ds}$, $$I_d=\tfrac{1}{2}\beta(V_{gs}-V_t)^2 \quad \text{(II)}$$

The dotted line by which divides these two regions is represented by equation III.

$$V_{gs}-V_t=V_{ds} \quad \text{(III)}$$

Moreover, when the conditions of equation IV occur, the NMOS transistor hardly allows current to flow.

$$V_{gs}<V_t \quad \text{(IV)}$$

A similar relationship also occurs in a PMOS transistor. FIG. 2 shows a circuit where the two NMOS transistors M0 and M1 are connected, where the length of the gate and the width of the channel of both NMOS transistors M0 and M1 are equal.

Because the gate terminal and the drain terminal are short-circuited, the NMOS transistor M0 operates within the range of the pentode region regardless of the current flow of constant current source 101. The gate-source voltage of NMOS transistor M1 is equal to the voltage the gate and the source of M0. Therefore, when the drain-source voltage is sufficiently high, NMOS transistor M1 operates within the range of the pentode region. This circuit is called a current mirror circuit because it is used to make the drain current of NMOS transistor M1 equal to the drain current of NMOS transistor M0.

In this current mirror circuit of related art, the current flowing in NMOS transistor M1 decreases when drain-source voltage of the transistor M1 decreases, and the transistor M1 begins to operate in triode region. As a result, the current value that flows in NMOS transistor M0 differs from that of NMOS transistor M1, and the current mirroring deteriorates.

Recently, semiconductor circuits have been required to operate on lower supply voltages. When current mirror circuits such as the one shown in FIG. 2 operate on a lower supply voltage, the drain-source voltage of the NMOS transistor M1 drops and the operation margin of the current mirror decrease.

In the pentode region, $$V_{gs}-V_t<V_{ds} \quad \text{(V)}$$

Then, it is possible to avoid this problem by lowering the threshold voltage of $V_t$ for M0 and M1. However, the circuits having transistors which have a lowered threshold voltage are excessively costly to manufacture.

Moreover, the drain current of the pentode region is shown more accurately by the next expression.

When $(V_{gs}-V_t<V_{ds})$, $$I_d=\tfrac{1}{2}\beta(V_{gs}-V_t)^2(1+\lambda V_{ds}) \quad \text{(VI)}$$

where $\lambda$ is a fitting parameter.

Even if NMOS transistor M1 operates in the pentode region, an accurate current mirroring cannot be obtained because the drain current of M1 has dependency on the drain-source voltage. To address this problem the circuit shown in FIG. 3 has been proposed. NMOS transistors are placed in series in order to suppress changes of the drain voltage of transistor M11, which mirrors the current. Decreasing operation margin associated with lower supply voltages has occurred since connecting a compensation means such as transistor M11 to a mirror current in series and this technique runs counter to the trend of using lower voltages for semiconductor circuits.

SUMMARY OF THE INVENTION

One object of this present invention is to solve the above-mentioned problems of the prior art by providing a current mirror circuit that can increase the lower supply voltage operation margin of the current mirror operation, thereby obtaining an excellent current mirror circuit, even with a low-voltage power supply, and alleviating the drain-source dependency of the mirror current.

According to one aspect of the present invention, a circuit that provides an excellent mirror current that does not deteriorate, even when the power source becomes lower supply voltage. In a presently preferred embodiment, A mirror current flows in a first MOS transistor when a constant current flows in the MOS transistor from a current source. An operational unit outputs the difference between voltage $V_{g1}$ of the gate of the MOS transistor and voltage $V_{d1}$ of the drain, and applies this difference to the gate of a second MOS transistor. When the power-supply voltage of this circuit becomes lower and the absolute value of $V_{d1}$ decreases, the MOS transistors enter the triode region, and the mirror current decreases. When the absolute value of $V_{d1}$ decreases, because the difference between $V_{g1}$ and $V_{d1}$ becomes larger, the drain current of the second MOS transistor increases, and the amount by which the mirror current decreases is counterbalanced.

DETAILED DESCRIPTION OF EMBODIMENTS

Figure 1:
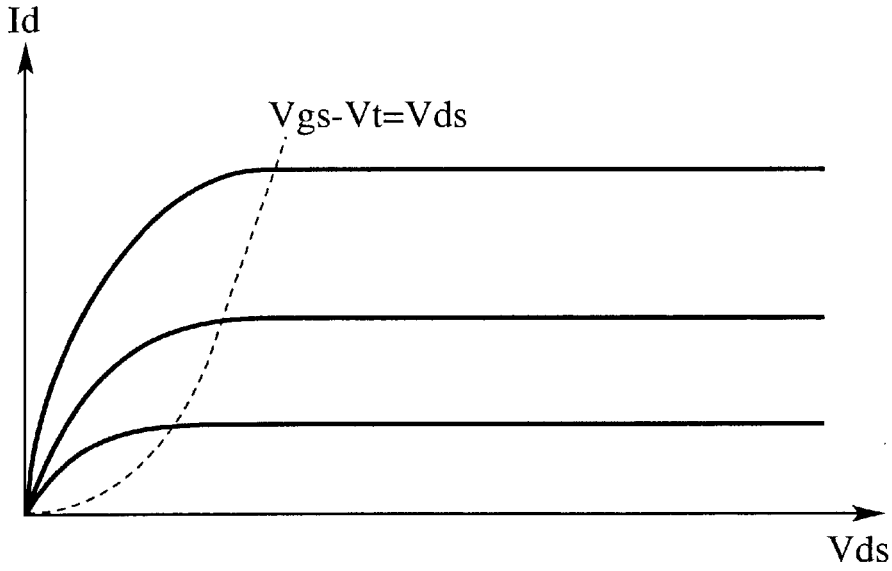
FIG. 1 illustrates the static characteristics of plotting the drain current against the drain-source voltage of the NMOS transistor.
Figure 2:
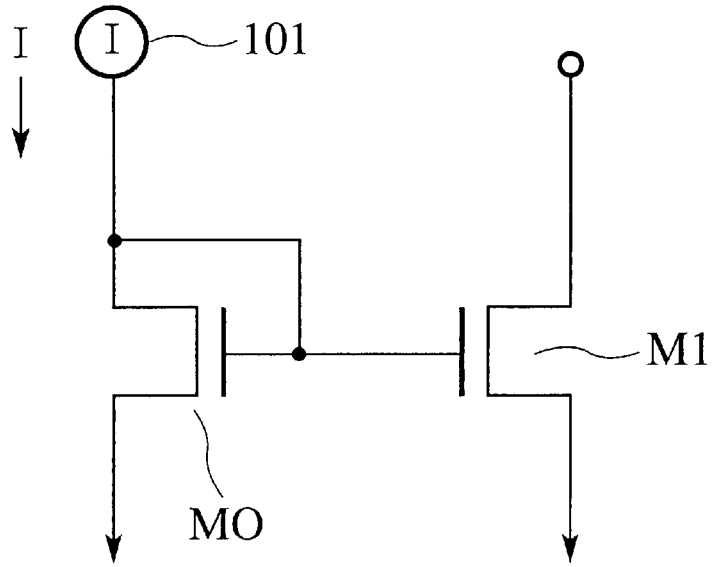
FIG. 2 is a circuit diagram showing an example of a current mirror circuit of related art.
Figure 3:
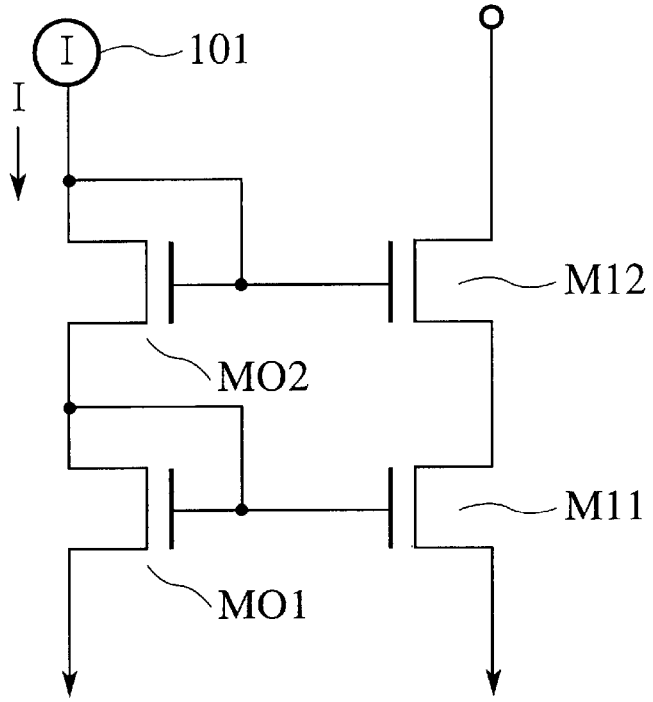
FIG. 3 is a circuit diagram showing another example of a current mirror circuit of related art.

Various embodiments of the present invention will be described with reference to the accompanying drawings. It is to be noted that same or similar reference numerals are applied to the same or similar parts and elements throughout the drawings, and the description of the same or similar parts and elements will be omitted or simplified.

Figure 4:
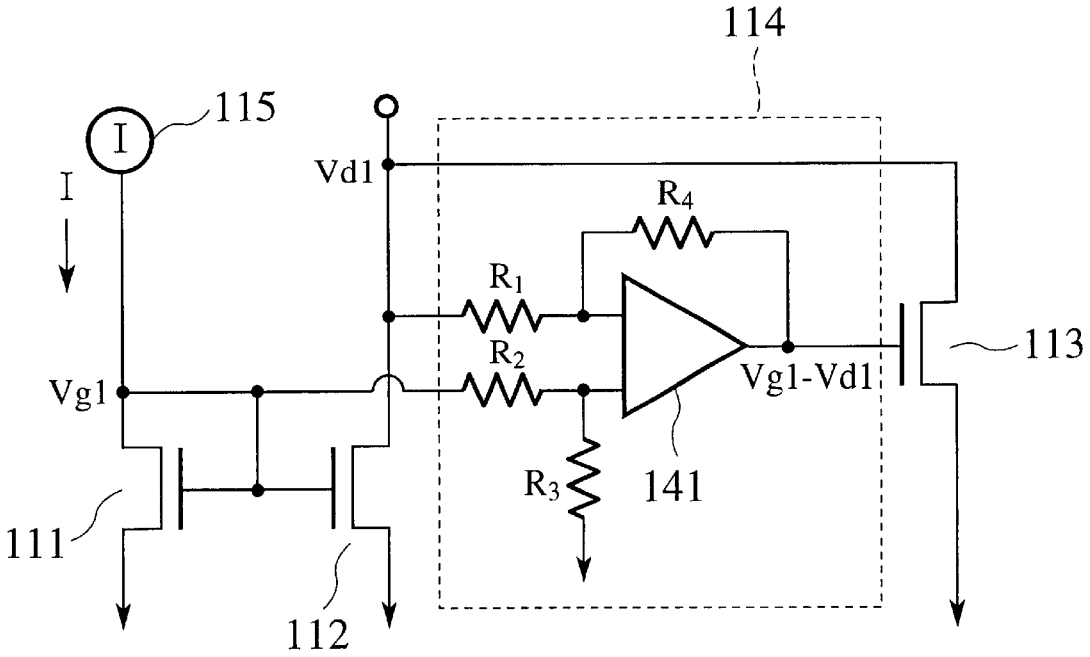
FIG. 4 is a circuit diagram of a first embodiment of a current mirror circuit of the present invention.

FIG. 4 is a circuit diagram according to a first embodiment of a current mirror circuit of the present invention. The current mirror circuit includes NMOS transistors 111 and 112. The current mirror circuit firer includes a compensation circuit to improve the effects of the current mirror circuit. The compensation circuit includes a subtracter 114 and an NMOS transistor 113. The result of the subtracter 114 is input to the gate of NMOS transistor 113. The subtracter 114 is a circuit that outputs the voltage difference between two input signals to the output terminal. The subtracter 114 includes an operational unit 141 and a plurality of resistors R ($R_1$–$R_4$). The voltage $V_{g1}$ of the gates of the NMOS transistors 111 and 112, as well as the voltage $V_{d1}$ of the drain of the NMOS transistor 112 are input to the subtracter 114, and the subtracter 114 subtracts $V_{d1}$ from $V_{g1}$. The result ($V_{g1}-V_{d1}$) is output to the gate of the NMOS transistor 113. In comparison to the on-resistance regarding the operating point of the transistor 112 and the transistor 113, the resistance values of the four resistors $R_1$ to $R_4$ are made sufficiently large enough to restrain $V_{g1}$ and $V_{d1}$ from the fluctuations.

The NMOS transistor 111 operates in the pentode region because the drain and the gate are connected, and current I generated from the constant-current source 115 flows through the drain and the source of NMOS transistor 111. Here, suppose the drain-source voltage $V_{d1}$ of NMOS transistor 112 is sufficiently high so that NMOS transistor 112 is operating in the pentode region. The gate-source voltage $V_{g1}$ of NMOS transistor 112 is the same as the NMOS transistor 111, and therefore the current I is the same as the current between the drain and the source of NMOS transistor 112. The operational unit 141 subtracts ($V_{g1}-V_{d1}$), and applies the result to the gate of the NMOS transistor 113. However, when ($V_{g1}-V_{d1}$) becomes negative, 0V is acceptable as the gate voltage of NMOS transistor 113.

When drain-source voltage $V_{d1}$ decreases because the circuit is operating with a lower supply voltage, NMOS transistor 112 operates in the triode region, and the mirror current that flows in NMOS transistor 112 decreases. However, when $Vd_1$ decreases, the value of $V_{g1}-V_{d1}$ increases and the current that flows in NMOS transistor 113 increases. This replenishes the decrease of the mirror current that flows in NMOS transistor 112 and makes sum of the current that flows in transistors 112 and 113 almost uniform. As a result, the mirror current operation region will extend even when the circuit is operating with a lower supply voltage.

The following is a quantitative explanation of the above-mentioned operation.

The drain current of NMOS transistor 112 is represented as follows:

If $V_{g1}<V_t$, then $I_d=0$

If $V_{d1}<(V_{g1}-V_t)$, then $I_d=\beta[(V_{g1}-V_t)V_{d1}-\frac{1}{2}V_{d1}^2]$ If $V_{d1}>(V_{g1}-V_t)$, then $I_d=\frac{1}{2}\beta(V_{g1}-V_t)^2$ Therefore, when the drain-source voltage is smaller than $V_{g1}-V_t$, the current that is mirrored decreases according to the desired value.

On the other hand, when the voltage between the gate and the source is $V_{g1}-V_{d1}$, the following represents the drain current of NMOS transistor 113:

If $V_{g1}-V_{d1}<V_t$, then $I_d=0$

If $V_{d1}<(V_{g1}-V_t)/2$, then $I_d=\beta[(V_{g1}-V_d-V_t)V_{d1}-\frac{1}{2}V_{d1}]$ If $V_{d1}>(V_{g1}-V_t)/2$, then $I_d=\frac{1}{2}\beta(V_{g1}-V_{d1}-V_t)^2=\frac{1}{2}\beta(V_{g1}-V_t)^2-\beta[(V_{g1}-V_t)V_{d1}-\frac{1}{2}V_{d1}^2]$ The sum of the currents for NMOS transistors 112 and 113 becomes as follows:

If $V_{g1}<V_t$, then $I_d=0$

Figure 5:
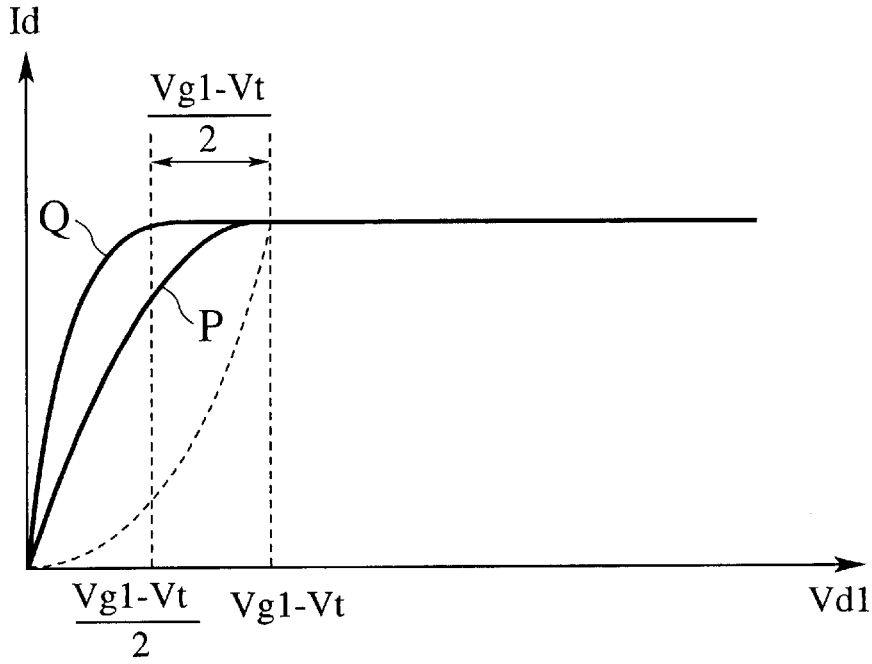
FIG. 5 is a plot of the relationship between the drain current and the voltage drain of the NMOS transistor.

If $V_{d1}<(V_{g1}-V_t)/2$, then $I_d=\beta[(V_{g1}-V_t)V_{d1}-\frac{1}{2}V_{d1}^2]+\beta[(V_{g1}-V_{d1}-V_t)V_{d1}-\frac{1}{2}V_{d1}^2]=\beta[(V_{g1}-2V_{d1}-V_t)V_{d1}-\frac{1}{2}V_{d1}^2]$ If $V_{d1}>(V_{g1}-V_t)/2$, then $I_d=\frac{1}{2}\beta(V_{g1}-V_t)^2$ Therefore, if the drain-source voltage is larger than $(V_{g1}-V_t)/2$, the sum total of the flowing current becomes constant. Accordingly, as indicated by the line Q in FIG. 5, even if during operation the drain-source voltage lowers to $(V_{g1}-V_t)/2$, the mirroring of the current will not deteriorate. Compared to line P of related art, the region of the current mirror expands into the low voltage region by at least $(V_{g1}-V_t)/2$. By adding the compensation circuit including the subtraction circuit 114 and the NMOS transistor 113, the characteristics of the current mirror are able to expand into a region with low voltage.

Figure 6:
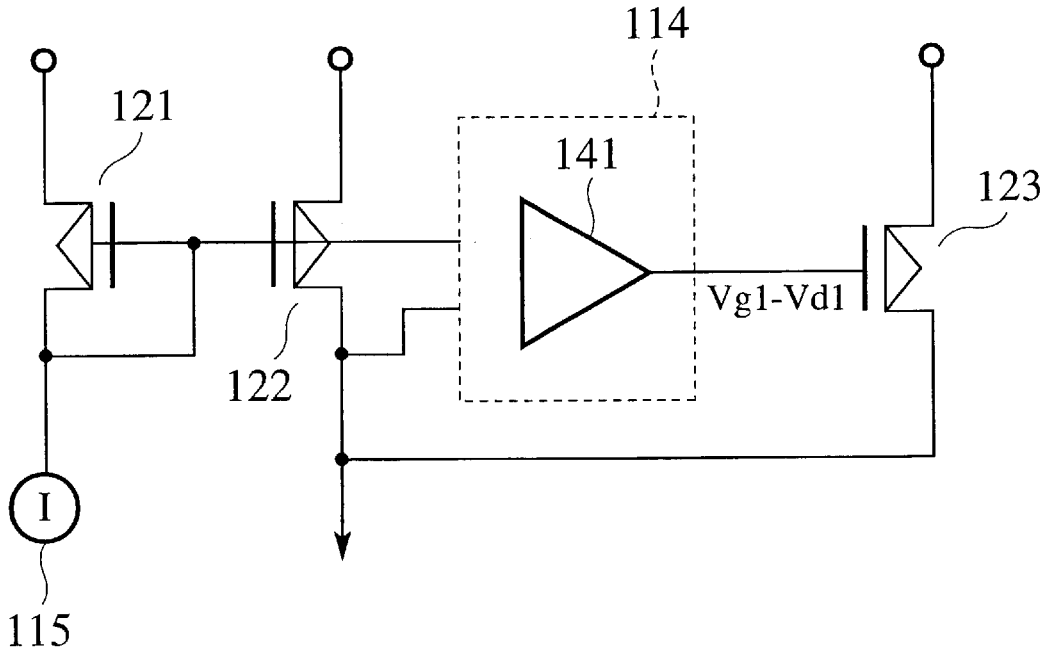
FIG. 6 is a circuit diagram of a second embodiment of a current mirror circuit of the present invention.

FIG. 6 is a circuit diagram of a second embodiment of a current mirror circuit of the present invention. The second embodiment of FIG. 6 uses similar corresponding parts as the first embodiment indicated in FIG. 4, and has been appropriately abbreviated to avoid redundancy. In this embodiment, a similar result has been achieved with the circuit layout as the first embodiment. The circuit in this embodiment includes PMOS transistors 121, 122 and 123, which have the opposite channel type as the NMOS transistor of the first embodiment.

Figure 7:
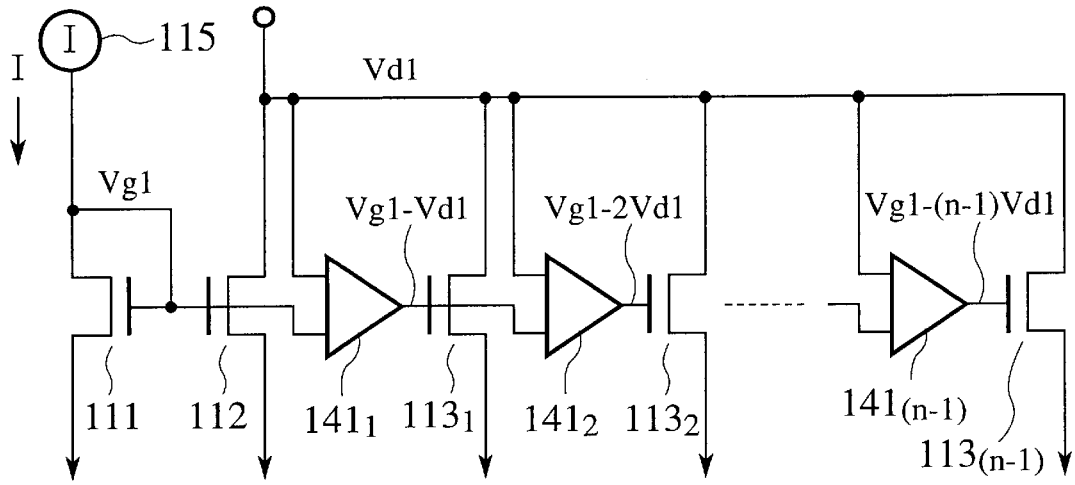
FIG. 7 is a circuit diagram of a third embodiment of a current mirror circuit of the present invention.

FIG. 7 is a circuit diagram of a third embodiment of a current mirror circuit of the present invention. The third embodiment of FIG. 7 uses similar corresponding parts as the first embodiment indicated in FIG. 4, but has been appropriately abbreviated. In this embodiment, the current mirror circuit includes NMOS transistors 111 and 112. Connected to the current mirror circuit in multiple stages are a plurality NMOS transistors $\mathbf{113}_1$,$\mathbf{113}_2$, . . . , $\mathbf{113}_{(n-1)}$ and subtracters $\mathbf{141}_1$, $\mathbf{141}_2$, . . . , $\mathbf{141}_{(n-1)}$. Thus, $V_{g1}-V_{d1}$, which is the result of subtracter $\mathbf{141}_1$, is input to the gate of NMOS transistor 113 in the first stage. And $V_{g1}-2V_{d1}$, which is the result of the subtracter $\mathbf{141}_2$, is input to the gate of NMOS transistor $\mathbf{113}_2$ in the second stage. And so on until the last subtracter $\mathbf{141}_{(n-1)}$.

Therefore, the values of the arithmetic series of $V_{g1}-V_{d1}$ to $V_{g1}-(n-1)\ V_{d1}$ are applied to each NMOS transistors $\mathbf{113}_1$, $\mathbf{113}_2$, . . . , $\mathbf{113}_{(n-1)}$. In other word, voltages of the arithmetic series of $a_k$ are applied to the gate-source of the NMOS compensation transistor respectively. where $a_k$ is the arithmetic series equal to $V_{g1}-kV_{d1}(k=1, 2, \ldots, n-1)$, $V_{d1}$ is the drain-source voltage of the second transistor, $V_{g1}$ is the gate-source voltage of the second transistor, and n is the number of the NMOS transistors of the compensation circuit.

As a result, each stage of the compensation circuit operates in a similar way as the compensation circuit in FIG. 4. In this embodiment of the present invention, the sum of the current of sources of NMOS transistors $\mathbf{113}_1$, $\mathbf{113}_2$, . . . , $\mathbf{113}_{(n-1)}$ and the current source of NMOS transistor 112 come from the mirror current of NMOS transistor 112. Moreover, it is possible to expand the current mirror characteristics to an operation with a low voltage to a greater extent than that of the first embodiment because the third embodiment has a compensation circuit that is connected in multiple stages. Therefore, excellent current mirror characteristics can be obtained, especially with a semiconductor circuit that is operating on a lower supply voltage.

Figure 8:
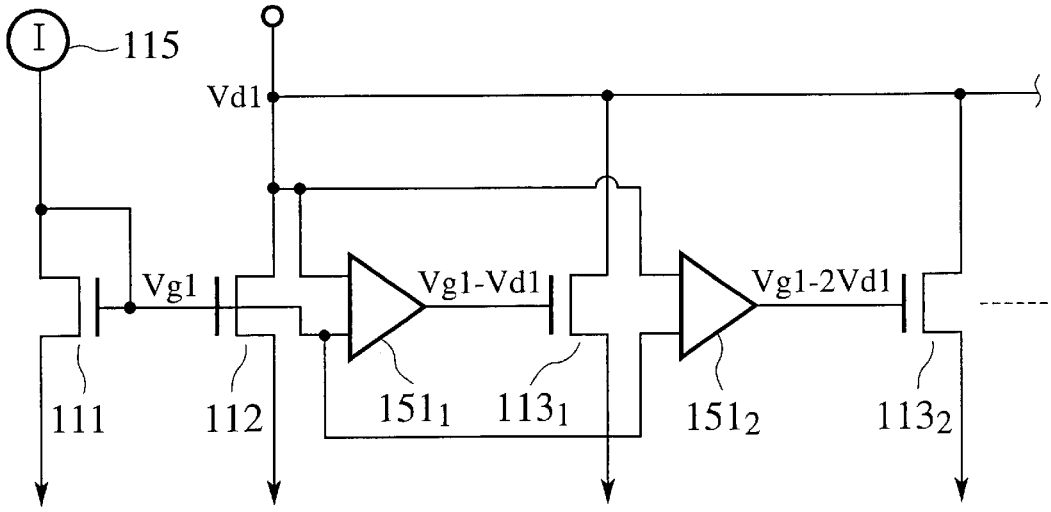
FIG. 8 is a circuit diagram of a fourth embodiment of a current mirror circuit of the present invention.

FIG. 8 is a circuit diagram of a fourth embodiment of a current mirror circuit of the present invention. The fourth embodiment of FIG. 8 uses similar corresponding parts as the third embodiment indicated in FIG. 7, and has been appropriately abbreviated. In the fourth embodiment, the current mirror circuit includes NMOS transistors 111, 112, and a compensation circuit The compensation circuit includes a plurality of NMOS transistors $\mathbf{113}_1$, $\mathbf{113}_2$, etc. and subtracters $\mathbf{151}_1$, $\mathbf{151}_2$, etc. Connected to the current mirror circuit in multiple stages is the plurality of NMOS transistors $\mathbf{113}_1$, $\mathbf{113}_2$, etc., and subtracters $\mathbf{151}_1$, $\mathbf{151}_2$, etc. The subtracters $\mathbf{151}_1$, $\mathbf{151}_2$, etc., input and subtract the drain voltage and the gate voltage of NMOS transistor 112. That is, the subtracter outputs $V_{g1}-V_{d1}$ and the result of this subtraction is input to the gate of NMOS transistor $\mathbf{113}_1$. And subtracter $\mathbf{151}_2$ outputs $V_{g1}-2V_{d1}$, and the result of this subtraction is input to the gate of NMOS transistor $\mathbf{113}_2$. A similar operation occurs as that shown in FIG. 7. As a result, an excellent current-mirror operation can be obtained, even when the semiconductor circuit is used under conditions of lower supply voltage.

Moreover, in the fourth embodiment, similar to the third embodiment as shown in FIG. 7, for the individual subtracters $\mathbf{151}_1$, $\mathbf{151}_2$, etc., the operation does not occur by using the operation result of the subtracter of the previous stage. Therefore, even if the compensation circuit is connected in multiple stages, the speed of the response does not worsen even with lower supply voltage.

Figure 9:
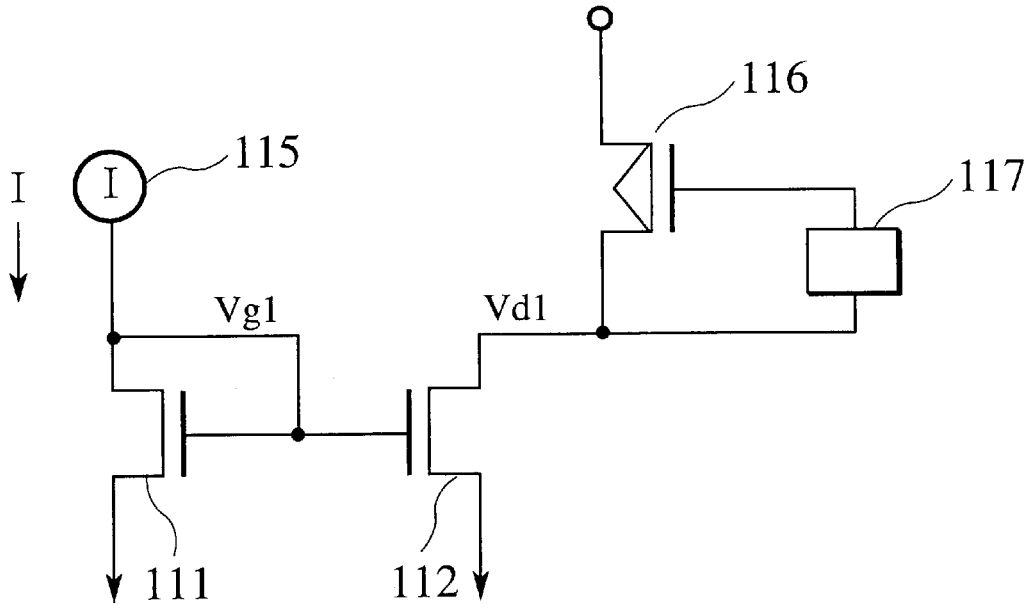
FIG. 9 is a circuit diagram of a fifth embodiment of a current mirror circuit of the present invention.

FIG. 9 is a circuit diagram of a fifth embodiment of a current mirror circuit of the present invention. The current mirror circuit includes transistors 111, 112, and a compensation circuit. The compensation circuit includes a PMOS transistor 116 and a level converter 117. Current is supplied to the drain of NMOS transistor 112 through PMOS transistor 116. The bias voltage is applied to the gate-drain of PMOS transistor 116 through the level converter 117.

The gate-drain voltage shown as monotonous decrease function of drain-source voltage is applied to the gate of PMOS transistor 116. Then, the bias voltage applied to the gate of the PMOS transistor 116 comes into decreasing as increasing in the voltage $V_{d1}$ of the drain of the NMOS transistor 112. Then the current in the PMOS transistor 116 increase, the current in the NMOS transistor 112 comes into decreasing. Then, though drain-source voltage $V_{d1}$ increases, the mirror current is constantly maintained.

Therefore, In this embodiment, adding the PMOS transistor 116 and the level converter 117 to the NMOS transistor 112, the drain-source voltage dependency of the mirror current in the pentode region of NMOS transistor 112 can be alleviated.

Figure 10:
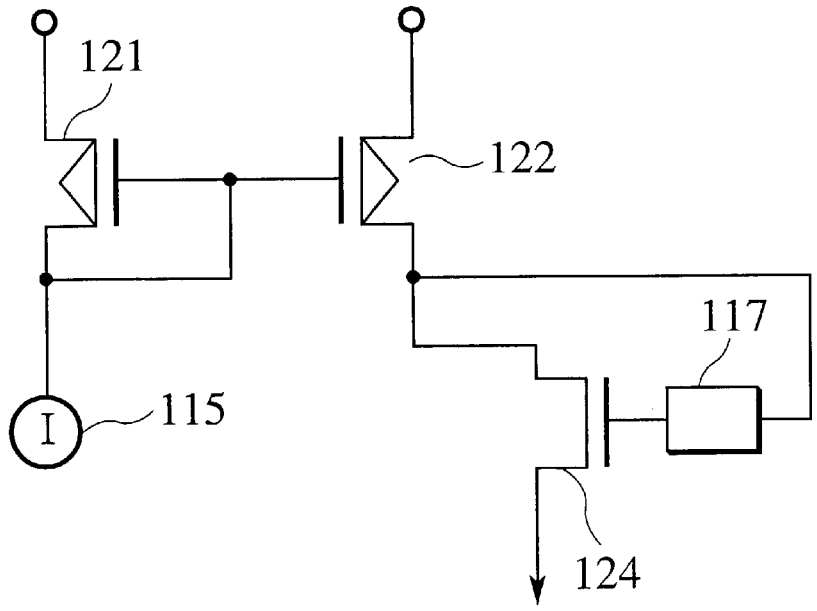
FIG. 10 is a circuit diagram of a sixth embodiment of a current mirror circuit of the present invention.

FIG. 10 is a circuit diagram of a sixth embodiment of a current mirror circuit of the present invention. The sixth embodiment of FIG. 10 uses similar corresponding parts as the fifth embodiment illustrated in FIG. 9, and has been appropriately abbreviated. The current mirror circuit includes PMOS transistors 121, 122, and a compensation circuit. The compensation circuit includes an NMOS transistor 124, and a level converter 117. The NMOS transistor 124 is connected to the drain of the PMOS transistor 122. The mirror current is almost held at a fixed value because the gate of the NMOS transistor 124 is connected to the source through the level converter 117 that is a mono addition function for the absolute value of the source drain voltage. Therefore, the gate of the NMOS transistor 124 constantly maintains the mirror current that flows from the PMOS transistor 122. This sixth embodiment can also alleviate the dependency of the drain-source voltage on the mirror current in the pentode region of the PMOS transistor 122.

Figure 11:
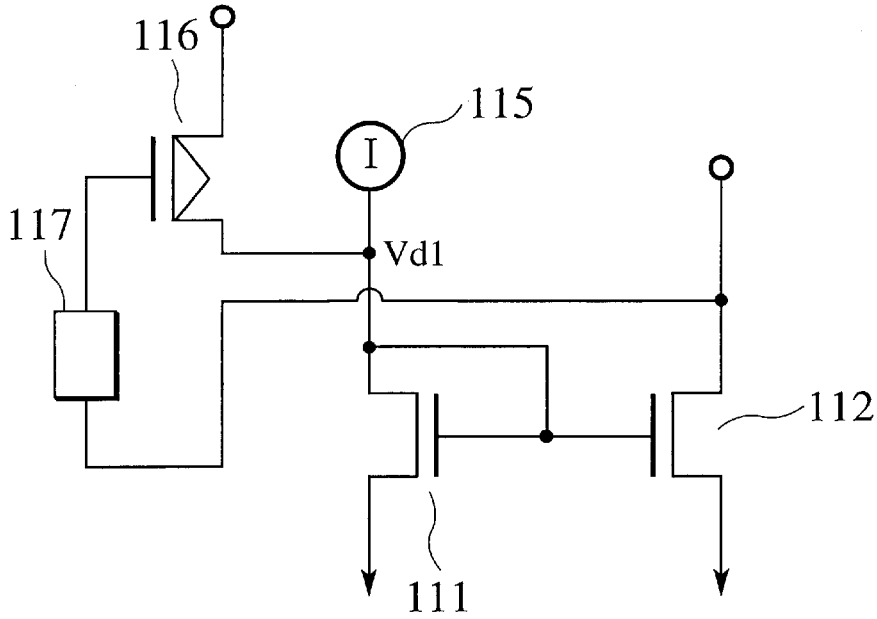
FIG. 11 is a circuit diagram of a seventh embodiment of a current mirror circuit of the present invention.

FIG. 11 is a circuit diagram of a seventh embodiment of a current mirror circuit of the present invention. The seventh embodiment of FIG. 11 uses similar corresponding parts as the fifth embodiment illustrated in FIG. 9 and has been appropriately abbreviated. The current mirror circuit includes NMOS transistors 111, 112, a PMOS transistor 116, and a level converter 117. The drain of NMOS transistor 111 is connected to the PMOS transistor 116, and current source 115 is connected to the drain of the NMOS transistor 111. Moreover, the gate of the PMOS transistor 116 is connected to the drain of NMOS transistor 112 to supply a bias voltage through the level converter 117 which has monotonous increase function.

The gate-source voltage expressed by a monotonous increase function of drain-source voltage is applied to the gate of PMOS transistor 116. Then, the bias voltage applied to the gate of the PMOS transistor 116 comes into increasing as increasing in the voltage $V_{d1}$ of the drain of the NMOS transistor 112, so that current added to the current from the current source 115 decreases. Therefore, though mirror current in the NMOS transistor 112 decreases, the increasing of mirror current by increasing voltage $V_{d1}$ is offset by the decreasing mirror current in the NMOS transistor 112. Then the mirror current is constantly maintained.

Therefore, in the seventh embodiment, the drain-source voltage dependency of the mirror current in the pentode region of PMOS transistor 116 can be alleviated.

Figure 12:
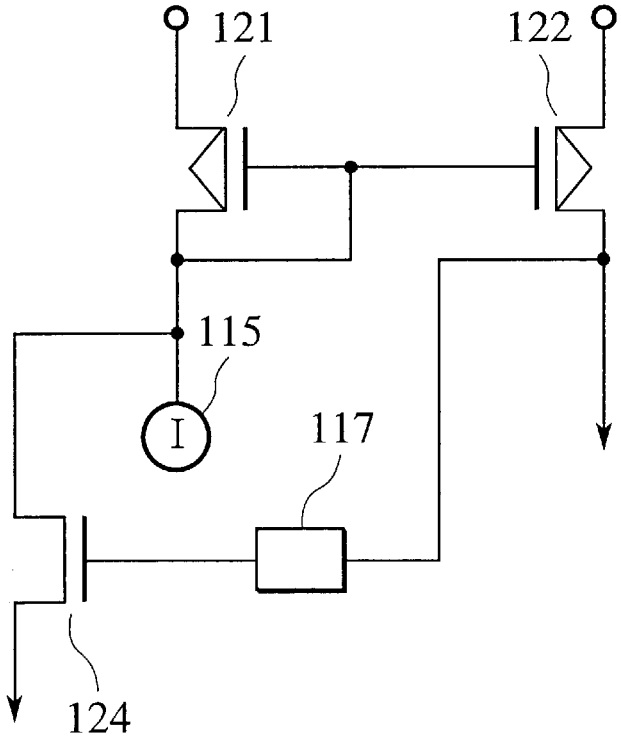
FIG. 12 is a circuit diagram of an eighth embodiment of a current mirror circuit of the present invention.

FIG. 12 is a circuit diagram of an eighth embodiment of a current mirror circuit of the present invention. The eighth embodiment of FIG. 12 uses similar corresponding parts as the eighth embodiment illustrated in FIG. 10, but has been appropriately abbreviated. In the eighth embodiment, PMOS transistors are employed in the circuit. The current mirror circuit includes PMOS transistors 121,122, an NMOS transistor 124, and a level converter 117. The NMOS transistor 124 is connected to the drain of the PMOS transistor 121. The gate of the NMOS transistor 124 is connected to the source of the PMOS transistor 122 through level converter 117 which has monotonous decrease function of the absolute value of the drain-source voltage. When a change occurs in the drain voltage of the PMOS transistor 122, the NMOS transistor 124 causes the drain current of the PMOS transistor 121 to change. This allows the mirror current of the PMOS transistor 122 to remain stable and constant. Therefore the eighth embodiment alleviates the drain-source voltage dependency of the mirror current in the pentode region of the PMOS transistor 122.

Figure 13:
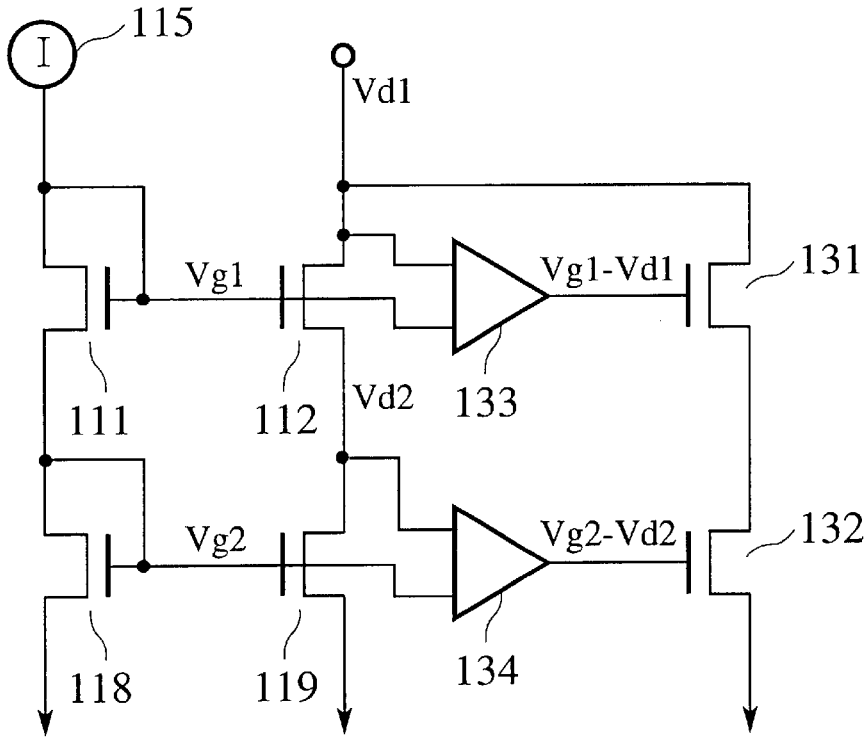
FIG. 13 is a circuit diagram of a ninth embodiment of a current mirror circuit of the present invention.

FIG. 13 is a circuit diagram of a ninth embodiment of a current mirror circuit of the present invention. The current mirror circuit includes NMOS transistors 111 and 118, NMOS transistors 112 and 119, which are respectively connected in series, and a compensation circuit.

The compensation circuit includes subtracter 133, and 134, and NMOS transistor 131, and 132. The subtracter 133 is connected to the drain of the NMOS transistor 112 as input. Also the subtracter 133 is connected to the gate of the NMOS transistor 131 as output. The subtracter 134 is connected to the drain of the NMOS transistor 119 as input. Also the subtracter 134 is connected to the gate of the NMOS transistor 132 as output. The drain of the NMOS transistor 131 is connected to the drain of the NMOS transistor 112. And the source of the NMOS transistor 131 is connected to the drain of the NMOS transistor 132. The source of the NMOS transistor 132 is connected to the ground voltage. That is, the NMOS transistor 131 and NMOS transistor 132 is connected in series.

In this embodiment, subtracter 133 subtracts drain-source voltage $V_{d1}$ from gate-source voltage $V_{g1}$ of the NMOS transistor 112, and applies the result to the gate-source of the NMOS transistor 131. The subtracter 134 subtracts drain-source voltage $V_{d2}$ from gate-source voltage $V_{g2}$ of the NMOS transistor 119, and applies the result to the gate-source of NMOS transistor 132.

Owing to the compensation circuit, the decrease of the mirror current of each stage including the NMOS transistors 111 and 112 as well as the NMOS transistor 118 and 119 because of the lower supply voltage is offset by the current that flows in the NMOS transistors 131 and 132. As a result, the stabilized sum of the drain currents that flow through the NMOS transistor 119 and 132 makes the mirroring not deteriorate in spite of lower supply voltage. And the region of the mirror current expands to the low-voltage region even more than related art.

In the ninth embodiment, The mirror current characteristics can be expanded to the low-voltage region to employ the compensation circuit including subtracters 133, and 134, and NMOS transistors 131, and 132. Therefore, even with the lower supply voltage of a semiconductor circuit, the good characteristics of a mirror current can be obtained. Moreover, the current mirror circuit in series can ease the dependency of the drain-source voltage of the mirror current in the pentode region.

Though in the ninth embodiment as illustrated in FIG. 13, the NMOS transistors 111 and 112 as well as the NMOS transistor 118 and 119 were made into a two-stage series circuit. Performance can also be improved in case of the three or more series stages are used. More performance can be achieved in case of a compensation circuit including NMOS transistor 131, subtracter 133, NMOS transistor 132, and subtracter 134 has a plurality of NMOS transistors and subtracters connected as illustrated in FIGS. 7 and 8.

Figure 14:
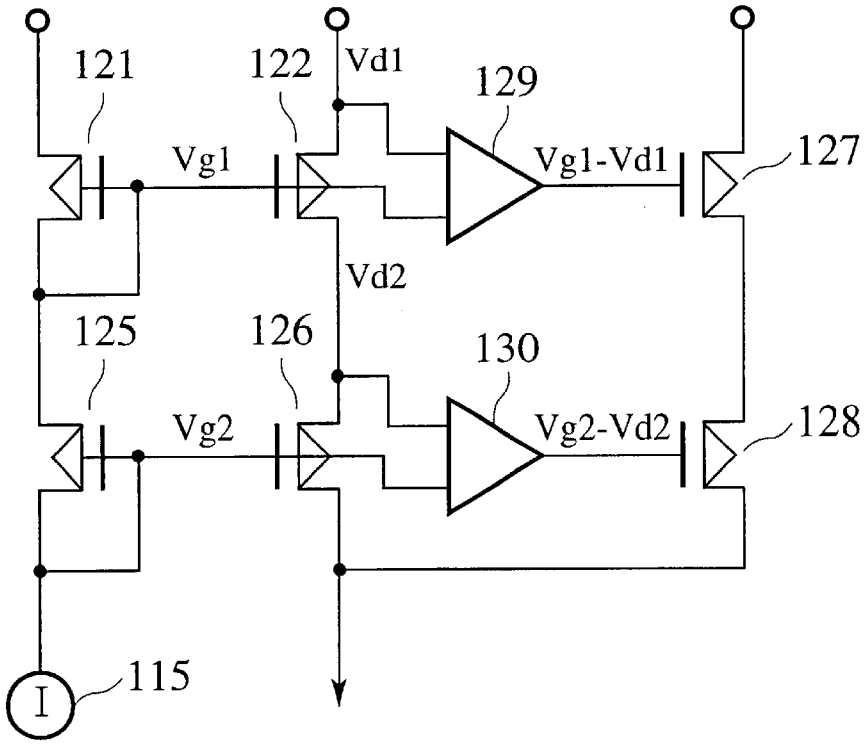
FIG. 14 is a circuit diagram of a tenth embodiment of a current mirror circuit of the present invention.

FIG. 14 is a circuit diagram of a tenth embodiment of a current mirror circuit of the present invention. The current mirror circuit includes PMOS transistors 121 and 122, PMOS transistors 125 and 126, which are respectively connected in series, and a compensation circuit.

The compensation circuit includes PMOS transistor 127 and subtracter 129 as well as PMOS transistor 128 and subtracter 130. The operation of the tenth embodiment is similar to that of the eighth embodiment, with the similar results. In the tenth embodiment as well performance can be improved with a structure that connects a plurality of compensation circuits or multistage current mirror circuits. An excellent mirror current can be obtained by increasing the lower supply voltage operation margin of the current-mirror operation, even with a low-voltage power supply. Moreover, the dependency of drain-source voltage of the mirror current is alleviated.

A current mirror circuit includes a circuit that references a current and another circuit that replicates the referenced current Therefore, the concept of the present invention can also be used in the following ways to make a current source circuit.

Figure 15:
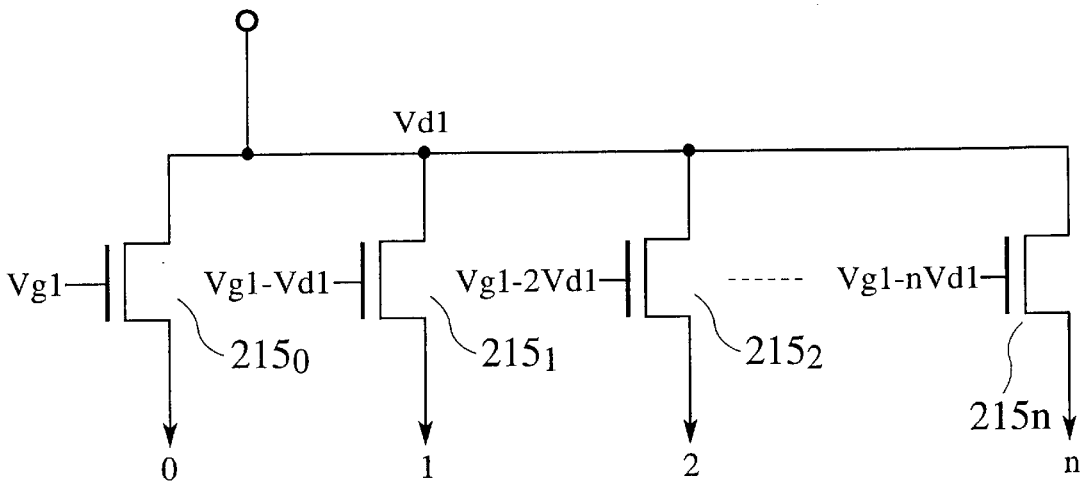
FIG. 15 is a circuit a circuit diagram of an eleventh embodiment of a current source circuit of the present invention.

FIG. 15 is a circuit diagram of an eleventh embodiment of a current source circuit of the present invention. In this embodiment, n NMOS compensation transistors $\mathbf{215}_1$, $\mathbf{215}_2$, . . . , $\mathbf{215}_n$ (n is the number of NMOS) are connected in parallel with a current source, these transistors include a NMOS transistor $\mathbf{215}_0$ which applied voltage $V_{g1}$ is applied to the gate-source, also applied voltage $V_{d1}$ is applied to the drain-source. An applied voltage ($V_{g1}-V_{d1}$) is applied to the gate of NMOS transistor $\mathbf{215}_1$. An applied voltage ($V_{g1}-2V_{d1}$) is applied to the gate of NMOS transistor $\mathbf{215}_2$. Similarly, an applied voltage ($V_{g1}nV_{d1}$) is applied to the gate of NMOS transistor $\mathbf{215}_n$. The voltages that apply to these NMOS transistors can express as an arithmetic series. The first term of the arithmetic series is $V_{g1}-V_{d1}$, the last term is $V_{d1}-nV_{d1}$, and difference between each term is $-V_{d1}$.

When voltage $V_{d1}$ decreases, the NMOS transistor $\mathbf{215}_0$ comes to operate in the triode region and the current that flows in the NMOS transistor $\mathbf{215}_0$ decreases. When the voltage $V_{d1}$ decreases, then the voltages ($V_{g1}-V_{d1}$), ($V_{g1}-2V_{d1}$), . . . ,($V_{g1}-nV_{d1}$) increase respectively. And also the current that flows through NMOS transistors $\mathbf{215}_1$, $\mathbf{215}_2$, . . . , $\mathbf{215}_n$ increases respectively. Because of the compensation of the decrease, the sum total of the current which flows through NMOS transistors $\mathbf{215}_0$, $\mathbf{215}_1$, $\mathbf{215}_2$, . . . , $\mathbf{215}_n$ can nearly be made constant. Therefore, the constant current region becomes extended under conditions of lower supply voltage, and the characteristics of constant-current source can be improved even if the semiconductor circuit operates in a low supply voltage.

Figure 16:
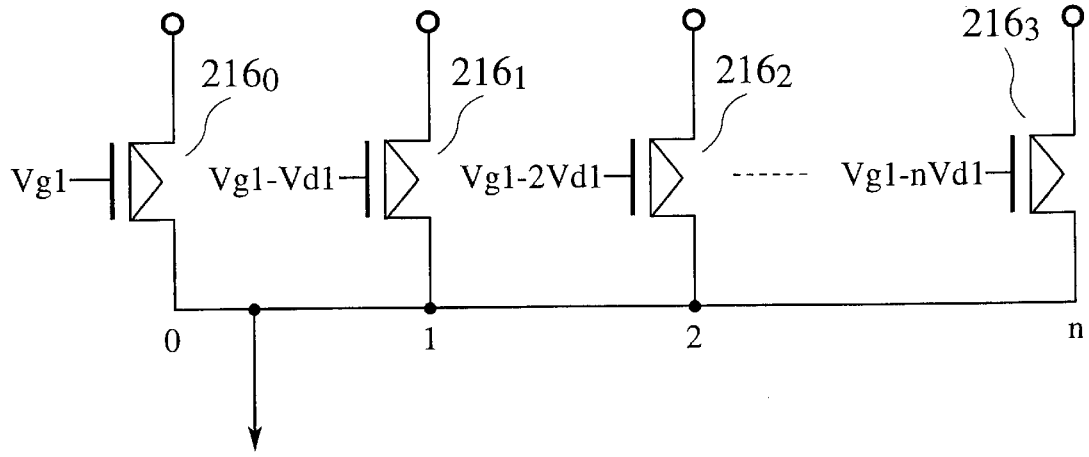
FIG. 16 is a circuit diagram of a twelfth embodiment of a current source circuit of the present invention.

FIG. 16 is a circuit diagram of an eleventh embodiment of a current source circuit of the present invention. In this embodiment, PMOS transistors are employed. The current source made from PMOS transistor $\mathbf{216}_0$ is connected in parallel with the compensation PMOS transistors $\mathbf{216}_1$, $\mathbf{216}_2$, . . . , $\mathbf{216}_n$. Therefore, the eleventh embodiment has a similar operation and result as the tenth embodiment.

Figure 17:
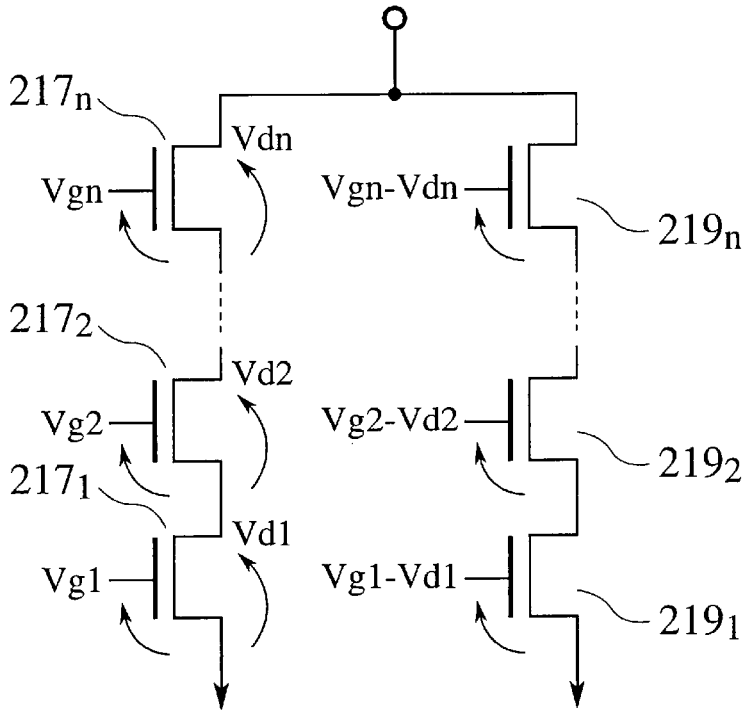
FIG. 17 is a circuit diagram of a thirteenth embodiment of a current source circuit of the present invention.

FIG. 17 is a circuit diagram of a twelfth embodiment of a current source circuit of the present invention. The twelfth embodiment includes a power source of n NMOS transistors $\mathbf{217}_1$, $\mathbf{217}_2$, . . . , $\mathbf{217}_n$ connected in series and a compensation circuit having n compensation NMOS transistors $\mathbf{219}_1$, $\mathbf{219}_2$, . . . , $\mathbf{219}_n$ connected in series. Between the gate and the source for each compensation NMOS transistor $\mathbf{219}_1$, $\mathbf{219}_2$, . . . , $\mathbf{219}_n$, the voltage ($V_{gi}$–$V_{di}$) is applied, wherein $V_{di}$(i=1 to n) is the drain-source voltage and $V_{gi}$(i=1 to n) is the gate-source voltage of the transistors $\mathbf{217}_1$, $\mathbf{217}_2$, . . . , $\mathbf{217}_n$, which form the power source.

Moreover, the drain of compensation NMOS transistor $\mathbf{219}_n$ and NMOS transistor $\mathbf{217}_n$, which forms the current source, are connected together respectively. The sources of NMOS transistor $\mathbf{217}_1$ and compensation NMOS transistor $\mathbf{219}_1$ are each connected to the ground voltage. When the circuit operates in a lower supply voltage, the transistors $\mathbf{217}_1$, $\mathbf{217}_2$, . . . , $\mathbf{217}_n$ shift from the pentode region to the triode region and the current which flows in the series circuit decreases. Then, the voltages ($V_{gi}$–$V_{di}$) applying to the gate-source of compensation NMOS transistors $\mathbf{219}_1$, $\mathbf{219}_2$, . . . , $\mathbf{219}_n$ increase. And the flow of the current for the series circuit of compensation NMOS transistors $\mathbf{219}_1$, $\mathbf{219}_2$, . . . , $\mathbf{219}_n$ increases. Namely the current decreasing is supplemented, thereby nearly constantly preserving the sum total of the current in both series circuits. Therefore, in the twelfth embodiment as well, the constant current region is extended to the low-voltage region, and even with a low-voltage semiconductor, the characteristics of the constant-current source are improved. Moreover, the constant-current source of a series connection can alleviate the dependency of the drain-source voltage of the constant current of the pentode region.

Figure 18:
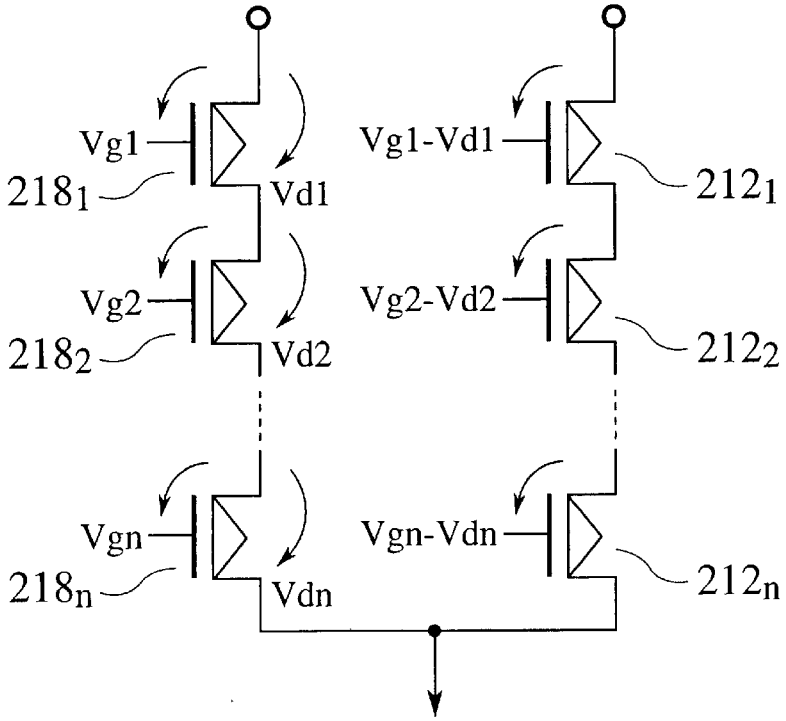
FIG. 18 is a circuit diagram of a fourteenth embodiment of a current source circuit of the present invention.

FIG. 18 is a circuit diagram of a thirteenth embodiment of a current source circuit of the present invention. In the thirteenth embodiment, PMOS transistors are employed. The power source is formed from PMOS transistors $\mathbf{218}_1$, $\mathbf{218}_2$, . . . , $\mathbf{218}_n$ and the corrective circuits are formed from PMOS transistors $\mathbf{212}_1$, $\mathbf{212}_2$, . . . , and $\mathbf{212}_n$. Accordingly, the operation and result of the thirteenth embodiment is similar to that of the twelfth embodiment.

Various modifications will become possible for those skilled in the art after receiving the teaching of the present disclosure without departing from the scope thereof.

What is claimed is:

1. A current mirror circuit comprising:

a first NMOS transistor having a gate, a drain connected to the gate, and a source connected to a ground voltage;

a second NMOS transistor having a gate connected to the gate of the first NMOS transistor, and a source connected the ground voltage; and a compensation circuit having at leant one compensation NMOS transistor having a source connected to the ground voltage, and a drain connected to the drain of the second NMOS transistor;

wherein a voltage which is lower than voltage $V_{g1}$ is applied to the gate-source voltage of the compensation NMOS transistor, the voltage, where $V_{g1}$ is gate-source voltage of the first and the second NMOS transistors.

2. The current mirror circuit as claimed in claim 1, wherein the compensation NMOS transistor has a gate length and channel width, respectively equal to that of the second NMOS transistor.

3. The current mirror circuit as claimed in claim 1, wherein voltages expressed by the arithmetic series $a_k$ are applied to the gate-source of the at least one compensation NMOS transistor respectively, where $a_k$ is the arithmetic series equal to $V_{g1}$–$kV_{d1}$ (k=1, 2, . . . , n), $V_{d1}$ is the drain-source voltage of the second transistor, $V_{g1}$ is the gate-source voltage of the second transistor, and n is the number of the NMOS transistors of the compensation circuit.

4. The current mirror circuit as claimed in claim 3, further comprising:

a first subtracter that generates the voltage of the first term (k=1) of the arithmetic series $a_k$, which is applied to the at least one NMOS transistor of the compensation circuit by the input of the voltages $V_{g1}$ and $V_{d1}$; and at least one or more subtracters that generate the voltage of second term (k=2), or after the first term (k=2, . . . , n) of the arithmetic series $a_k$ by input of the voltage $V_{d1}$ and the voltage which previous subtracter outputs.

5. The current mirror circuit according to claim 4, wherein the input impedance of the subtracter is larger than the impedance of the operating point of the PMOS transistor or the NMOS transistor connected to the input of the subtracter.

6. The current mirror circuit according to claim 3, wherein a subtracter generates the voltages of the arithmetic series $as_k$ from $V_{g1}$ and $V_{d1}$.

7. A current mirror circuit comprising:

a first group of at least two NMOS transistors connected in series, each of the first group of NMOS transistor has a gate, a drain connected to the gate, and a source;

a second group of NMOS transistors connected in series, the number of the second group of NMOS transistors is equal to the number of the first group of at least two NMOS transistors, each of NMOS transistor of the second group has a gate connected to the gate of the corresponding NMOS transistor of the first group, a drain, and a source; and a third group of NMOS transistors connected to the second group of NMOS transistors, the number of the third group of NMOS transistors is equal to the number of the second group of NMOS transistors, each of the third group of NMOS transistor connects in series;

wherein the source of the last NMOS transistor of the first group of NMOS transistors, the second group of NMOS transistors, and the third group of NMOS transistors are each connected to a ground voltage, the drain of the last NMOS transistor of the second and third groups of NMOS transistors are mutually connected, difference voltages between gate-source voltages and drain-source voltages of the each second group of NMOS transistors are applied to the gate-source of the third NMOS transistors which are the same position in series as the second group of NMOS transistors respectively.

8. A power source circuit comprising:

a first NMOS transistor having a source connected to a ground voltage; and at least one or more compensation NMOS transistors;

wherein the respective drains of the compensation NMOS transistors are each connected to the drain of the first NMOS transistor, the sources of the compensation NMOS transistors are connected to the ground voltage, and voltages expressed by arithmetic series of $a_k$ are applied to the gate-source voltage of each compensation NMOS transistor, where $a_k$ is the arithmetic series equal to $V_{g1}-kV_{d1}$ (k=1, 2, . . . , n), $V_{d1}$ is the drain-source voltage of the first transistor, $V_{g1}$ is the gate-source voltage of the first transistor, and n is the number of the NMOS transistors of the compensation circuit.

9. A power source circuit comprising:

a first NMOS transistor group having at last two or more NMOS transistors connected in series; and a second NMOS transistor group having at least two or more NMOS transistors connected in series;

wherein the source of the last NMOS transistor of the first NMOS transistor group and the second NMOS transistor group are each connected to a ground voltage, where the source of last NMOS transistor of a group of NMOS transistors is defined as the source terminal closest to a ground voltage, the drain of the last NMOS transistor of the first NMOS transistor group and the second NMOS transistor group are each mutually connected, where the drain of the last NMOS transistor of a group of NMOS transistors is defined as the drain terminal furthest from a ground voltage, and difference voltages between gate-source voltages and drain-source voltage of the each first group of NMOS transistor are applied to the gate source of the second NMOS transistors which is in same position in series as the first group of NMOS transistors.

* * * * *